US005934567A

United States Patent [19]

Fly

[11] Patent Number: 5,934,567

[45] Date of Patent: Aug. 10, 1999

[54] AIR ASSISTED FUEL INJECTOR

[75] Inventor: Ron G. Fly, Yorktown, Va.

[73] Assignee: Ford Motor Company, Dearborn, Mich.

[21] Appl. No.: 08/897,479

[22] Filed: Jul. 21, 1997

[51] Int. Cl.[6] ..... F02M 51/06

[52] U.S. Cl. ..... 239/408; 239/417.3; 239/423; 239/585.1

[58] Field of Search ..... 239/408, 423, 239/424, 424.5, 417.3, 417.5, 585.1–585.5, 533.12

[56] References Cited

U.S. PATENT DOCUMENTS

| | | | |
|---|---|---|---|
| 4,925,111 | 5/1990 | Foertsch et al. | 239/533.12 |
| 4,982,716 | 1/1991 | Takeda et al. | 239/533.12 X |
| 5,102,054 | 4/1992 | Halvorsen . | |
| 5,174,505 | 12/1992 | Shen . | |
| 5,218,943 | 6/1993 | Takeda et al. | 123/531 |
| 5,241,938 | 9/1993 | Takagi et al. . | |
| 5,301,879 | 4/1994 | Takeda et al. | 239/408 |
| 5,395,050 | 3/1995 | Nowak et al. . | |
| 5,540,387 | 7/1996 | Reiter et al. . | |
| 5,551,400 | 9/1996 | Rice et al. . | |
| 5,556,034 | 9/1996 | Sakakida et al. | 239/417.3 |
| 5,785,251 | 7/1998 | Wood | 239/417.3 |

FOREIGN PATENT DOCUMENTS

| | | |
|---|---|---|
| 0 740 069 A2 | 10/1996 | European Pat. Off. . |
| WO 92/14053 | 8/1992 | WIPO . |
| WO 97/20141 | 6/1997 | WIPO . |

*Primary Examiner*—Kevin Weldon
*Attorney, Agent, or Firm*—James J. Dottavio

[57] ABSTRACT

An air assisted fuel injector for an internal combustion engine includes a fuel nozzle having a fuel orifice and a targeting section cooperating with the fuel nozzle for targeting atomized fuel within the engine. A throttling section in disposed upstream of the targeting section and cooperates with the fuel nozzle. The throttling section throttles assist air prior to the air atomizing the fuel emerging from the fuel orifice. Thus, any adverse effects on fuel flow from the fuel injector due to back pressure variability downstream of the fuel nozzle are reduced. In a preferred embodiment, an air shroud is fitted on the nozzle of the fuel injector and includes both the throttling section and the targeting section.

20 Claims, 2 Drawing Sheets

AIR ASSISTED FUEL INJECTOR

FIELD OF THE INVENTION

This invention relates to air assisted fuel injectors, and, more particularly to, throttling assist air in such fuel injectors.

BACKGROUND OF INVENTION

Air assisted fuel injectors for automotive internal combustion engines take advantage of the natural air flow in an engine, due to manifold vacuum, to better atomize fuel spray, which, in turn, is known to improve combustion and efficiently reduce exhaust emissions. Typically, the engine includes an assist air passage which communicates with the fuel injector for providing assist air to the nozzle of the fuel injector for atomization. It is also known to use fuel injectors which target the fuel spray within the engine. However, assist air in such air assisted fuel injectors tends to disrupt any spray targeting which may be performed by the fuel injector.

European Patent Application #EP740,069 ('069) shows an air assisted fuel injector having an air shroud placed on the nozzle of the injector. Assist air is directed to the fuel spray as it emerges from the fuel injector nozzle for fuel atomization. Also, director holes are formed in the shroud for targeting the atomized fuel spray. According to '069, air is injected in the liquid fuel stream at the same location where fuel targeting is performed. Because the atomized fuel is contained within director holes, targeting may be maintained.

The inventor of the present invention has found certain disadvantages with prior art air assisted fuel injectors that attempt to maintain targeting. For example, with respect to '069, the gallery where assist air atomizes the fuel spray is relatively restricted. This restriction may adversely effect fuel flow from the fuel injector due to back pressure variability downstream of the fuel nozzle.

In addition, the shroud of the '069 patent requires that an air port be formed in the engine's cylinder head or intake manifold close to the fuel discharge point to feed assist air to the shroud. This is inconvenient due to the proximity of the fuel discharge point to the intake valve of the engine.

SUMMARY OF THE INVENTION

An object of the present invention is to provide a fuel injector capable of providing good atomization as well as fuel targeting while maintaining accurate fuel flow and reducing back pressure effects. This object is achieved, and disadvantages of prior art approaches are overcome, by providing a novel air assisted fuel injector for an internal combustion engine. The engine has a fuel injector air assist port, with the injector cooperating with the air assist port so as to atomize fuel entering the engine. In one particular aspect of the invention, the fuel injector includes a fuel nozzle having a fuel orifice and a targeting section cooperating with the fuel nozzle for targeting atomized fuel within the engine. The fuel injector further includes a throttle section disposed upstream of the targeting section and cooperating with the fuel nozzle. The throttling section throttles assist air prior to the assist air atomizing the fuel emerging from the fuel orifice. Thus, any adverse effects on fuel flow from the fuel injector due to back pressure variability downstream of the fuel nozzle may be reduced.

An advantage of the present invention is that low cost air assist fuel injector having good atomization and accurate targeting is provided.

Another advantage of the present invention is that the fuel injector and engine utilizing the injector may be easily manufactured.

Other objections, features and advantages of the present invention will be readily appreciated by the reader of this specification.

BRIEF DESCRIPTION OF THE DRAWINGS

The invention will now be described, by way of example, with reference to the accompanying drawings in which.

DETAILED DESCRIPTIONS OF THE PREFERRED EMBODIMENTS

Figure 1:
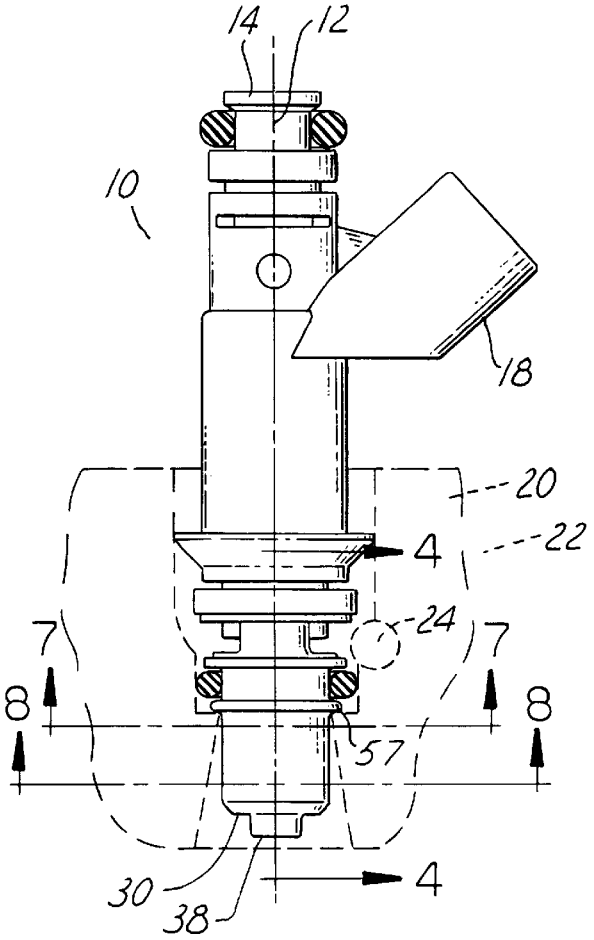
FIG. 1 is a side view of an air assisted fuel injector according to the present invention.
Figure 2:
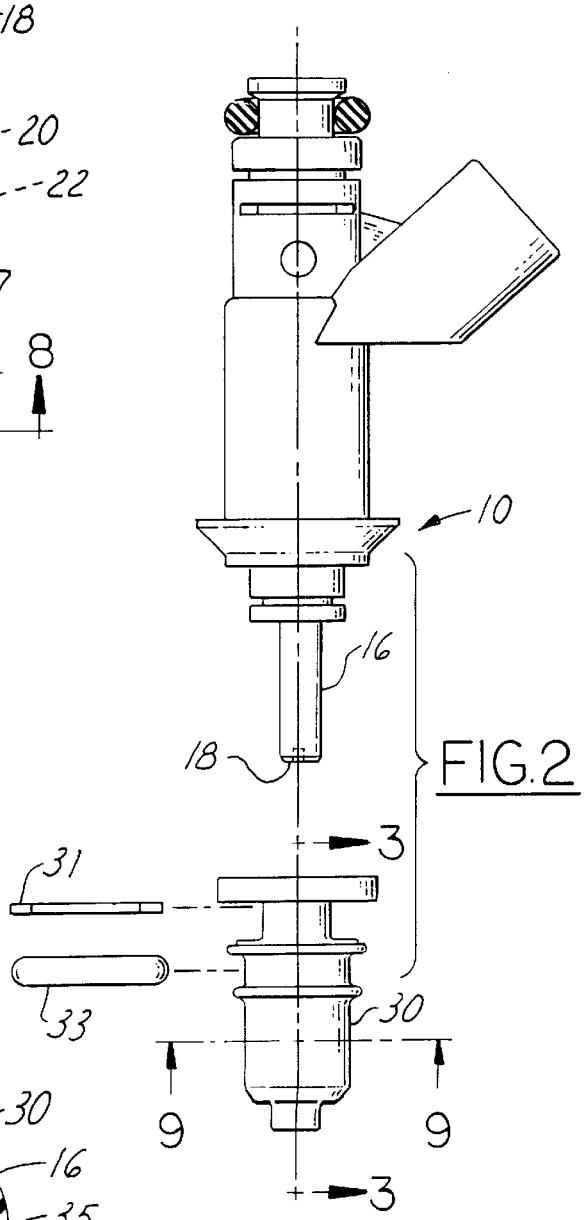
FIG. 2 is an exploded assembly view of the injector of FIG. 1.

Air assisted fuel injector 10, shown in FIGS. 1 and 2, which, in this example, is a top feed fuel injector, includes central longitudinal axis 12 with inlet 14 and nozzle 16 (see FIG. 2) at its opposite axial ends. Liquid fuel is dispensed by the operation of a conventional solenoid actuated needle valve (not shown) contained within fuel injection 10, which receives its signals from an engine controller (not shown) through fuel injector connector 18. Typically, fuel is delivered from a fuel rail (not shown) to inlet 14 and is controlled by the aforementioned solenoid valve. Fuel injector 10 is fitted within cylinder head 20 of internal combustion engine 22 to deliver fuel thereto. Alternatively, those skilled in the art will recognize in view of this disclosure that fuel injector 10 may be fitted to an intake manifold (not shown). For the sake of clarity, in the example described herein, fuel injector 10 is mounted to cylinder head 20. Engines utilizing air assisted fuel injectors according to the present invention include port 24, which may be formed in cylinder head 20, for delivering assist air to injector 10.

To assist in atomizing and targeting fuel emerging from fuel nozzle 16, as best shown in FIG. 2, fuel injector 10 includes air assist shroud 30 fitted on nozzle 16. Shroud 30 may be retained on nozzle 16 with clip 31, which may be keyed to shroud 30. Once shroud 30 is assembled to nozzle 16, clip 31 may be held in place via a laser weld or other fastening means known to those skilled in the art and suggested by the disclosure. As a result, shroud 30 is axially and radially retained and positioned on nozzle 16, as will be described hereinafter. For the sake of completeness, O-ring 33 may be positioned on shroud 30 to sealingly engage injector 10 within cylinder head 20.

Turning now to FIGS. 3–6, shroud 30 includes a generally cylindrical body 32 having sidewall 34, defining an inside surface 35, and bottom wall 36, which includes targeting section 38 formed therein for targeting atomized fuel emerging from nozzle 16 when air shroud 30 is inserted thereon. In this example, targeting section 38 is defined by a pair of diverter holes 39*a*, 39*b* orginating and conjoined together at bottom surface 36 and extending generally radially and axially at an angle relative to axis 12 so as to cause a targeted, diverging fuel spray pattern as atomized fuel exits shroud 30 and enters engine 22. The exact angle relative to axis 12 for targeting is dependent upon a variety of engine design considerations and may be readily determined by those skilled in the art. Also, those skilled in the art will recognize in view of this disclosure that any number of diverter holes may be formed in bottom 38 to cooperate with any number of fuel orifices 18 formed in nozzle 16 to meet the specific design criteria of a selected engine. In the example described with reference to FIGS. 1–9, nozzle 16 includes one orifice 18.

According to the present invention, air assist shroud 30 further includes throttling section 40 disposed upstream of targeting section 38. Throttling section 40 comprises recess 42 formed on inside surface 35 of sidewall 34 and extends along the axial direction of shroud 30. Recess 42 has a generally converging cross-section for throttling air flowing through air shroud 30, as will become further apparent with reference to FIGS. 7–9. Air shroud 30 further includes air port 44 for communicating with air assist port 24 of cylinder head 20. By providing throttling section 40 upstream of targeting section 38, any adverse effects on fuel flow from injector 10 due to back pressure variability downstream of nozzle 16 are reduced. Further, by providing a gradual decreasing cross-section of throttling section 40, assist air having a more laminar flow with reduced edge effects may be provided. This reduces the likelihood of a mismatched spray distribution flowing from targeting section 38 at partial engine manifold pressures (i.e., at pressures less that at wide open throttle).

Figure 3:
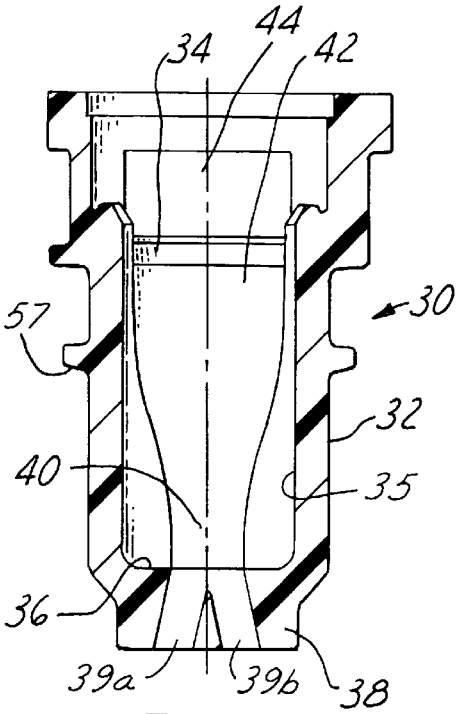
FIG. 3 is a cross-sectional view of a portion of the injector taken along line 3—3 of FIG. 2.
Figure 4:
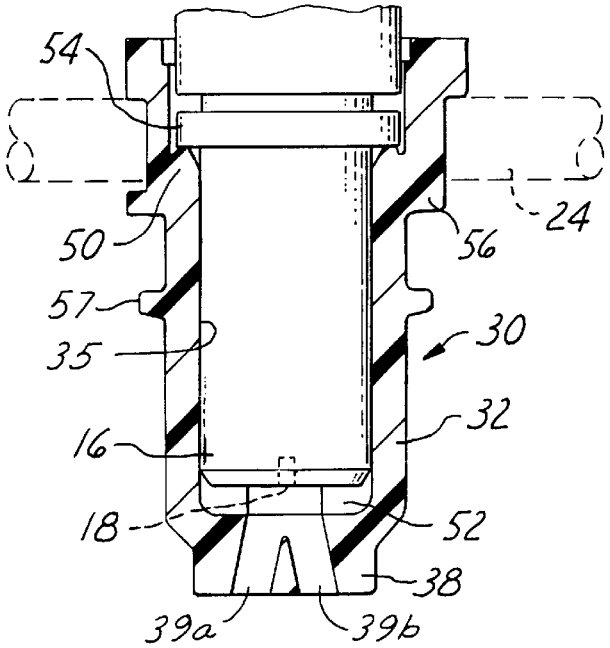
FIG. 4 is a cross-sectional view of a portion of the injector taken along line 4—4 of FIG. 1.
Figure 5:
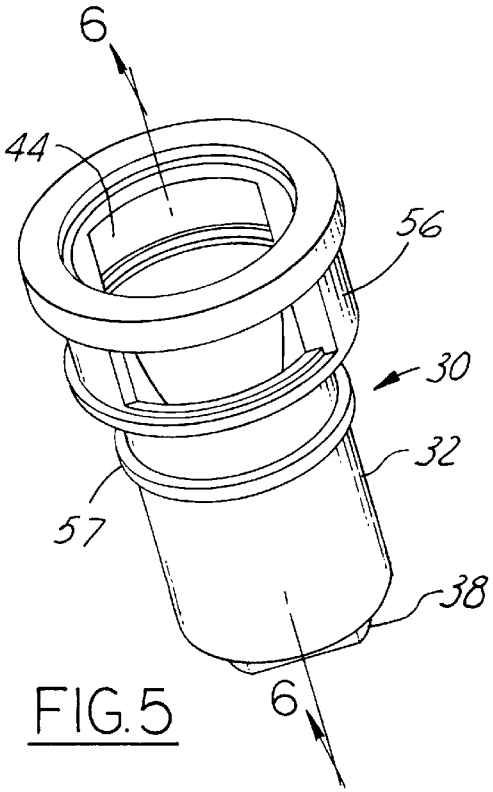
FIG. 5 is a perspective view of a portion of the injector of FIG. 1.
Figure 6:
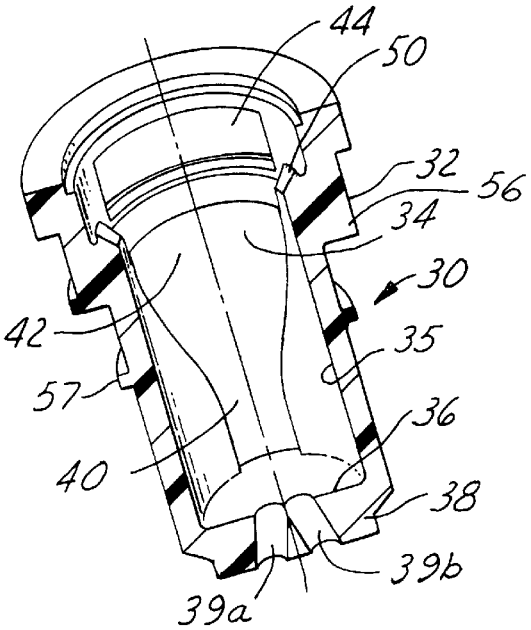
FIG. 6 is a cross-sectional view of a portion of the injector taken along line 6—6 of FIG. 5.

In FIGS. 1–9, shroud 30 is formed with two throttling sections 40, although in the cross-sections of FIGS. 3 and 6, one throttling section 40 is shown. However, in alternative embodiments, shroud 30 may be formed with any number of throttling sections 40 upstream of targeting section 38.

In a preferred embodiment, shroud 30 further includes a stop 50 formed on inside surface 35 of sidewall 34, which cooperates with shoulder 54 of fuel injector 10 for axially locating shroud 30 relative to nozzle 16. As a result, mixing chamber 52 is formed between sidewall 34, bottom 36 and nozzle 16 for aiding in mixing of assist air and fuel for better fuel atomization. Stops 50 may also cooperate with shoulder 54 to radially locate shroud 30 relative to nozzle 16. Shroud 30 may also include locating tab 56 formed on body 32 for radially locating fuel injector 10 relative to engine 22. Further, those skilled in the art will recognize in view of this disclosure that shroud 30 may also include stop 57 (see FIG. 1) for axially positioning injector 10 within cylinder head 20. With injector 10 radially located relative to engine 22, proper fuel targeting may be obtained.

Figure 9:
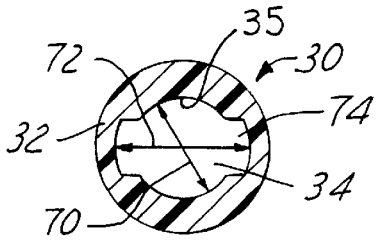
Figure 8:
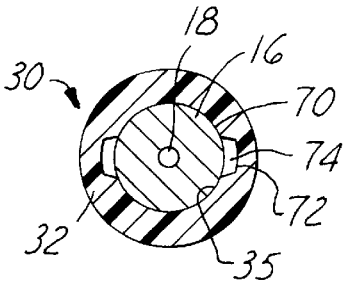
FIGS. 7 and 8 are cross-sectional views of the injector taken along lines of 7—7 and 8—8, respectively, of FIG. 1; and, FIG. 9 is a cross-sectional view of a portion of the injector taking along line 9—9 of FIG. 2.
Figure 7:
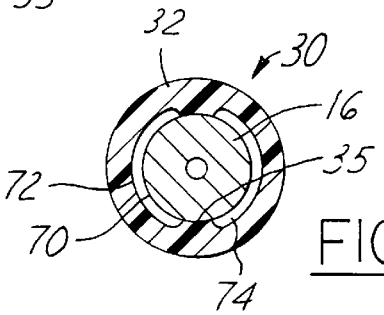

Referring specifically now to FIGS. 7–9, inside surface 35 of shroud 30 is defined by minor diameter 70 and major diameter 72. Minor diameter 70 is approximately equal to the diameter of nozzle 16 so that shroud 30 may fit over nozzle 16. Throttling section 40 is defined by space 74 between minor diameter 70 and major diameter 72. Space 74 generally converges along an axial direction extending toward targeting section 38. This is best shown by a comparison of FIGS. 7, 8 and 9. Specifically, in FIG. 7, which is a cross-section taken along line 7—7 of FIG. 1, the cross-sectional area of space 74 is relatively large. As space 74 proceeds along an axial direction toward targeting section 38, as shown first in FIG. 9 and again at FIG. 8, space 74 becomes relatively smaller. Thus, space 74 acts as a throttle for assist air flowing from port 44 toward mixing chamber 52.

While the best mode for carrying out the invention has been described in detail, those skilled in the art in which this invention relates will recognize various alternative designs and embodiments, including those mentioned above, in practicing the invention that has been defined by the following claims.

I claim:

1. An air assisted fuel injector for an internal combustion engine, the engine having a fuel injector air assist port, with said air assist fuel injector cooperating with the air assist port so as to atomize fuel entering the engine, with said fuel injector disposed longitudinally along an axis and comprising:

a fuel nozzle having a fuel orifice;

a targeting section cooperating with said fuel nozzle for targeting atomized fuel within the engine; and, a throttling section disposed upstream of said targeting section and cooperating with said fuel nozzle, with said throttling section including an air passage having a constricting cross section for throttling assist air prior to said assist air atomizing the fuel emerging from said fuel orifice.

2. A fuel injector according to claim 1 further comprising an air shroud fitted on said fuel nozzle, with said shroud comprising:

a generally cylindrical body having a sidewall and a bottom wall, with said bottom wall being formed with said targeting section and with an inside surface of said sidewall being formed with said throttling section.

3. A fuel injector according to claim 1 further comprising a mixing chamber disposed between said throttling section and said targeting section for mixing assist air and fuel so as to aid in atomizing the fuel.

4. A fuel injector according to claim 2 wherein said sidewall, said bottom wall and said fuel nozzle cooperate to define a mixing chamber for mixing assist air and fuel so as to aid in atomizing the fuel.

5. A fuel injector according to claim 2 further comprising a stop formed on said inside surface of said sidewall for axially locating said shroud relative to said fuel nozzle.

6. A fuel injector according to claim 5 wherein said stop radially locates said shroud relative to said fuel nozzle.

7. A fuel injector according to claim 5 wherein said stop axially locates said nozzle relative to said bottom wall to define a mixing chamber between said nozzle, said sidewall and said bottom.

8. A fuel injector according to claim 2 further comprising a port formed in said sidewall, with said port being adapted to communicate with the assist air port of the engine when the injector is installed in the engine.

9. A fuel injector according to claim 2 further comprising a means for axially and radially locating said shroud relative to said nozzle.

10. A fuel injector according to claim 2 wherein said shroud is formed with a locating tab for radially locating said injector relative to the engine.

11. An air assisted fuel injector for an internal combustion engine, the engine having a fuel injector air assist port, with said air assist fuel injector cooperating with the air assist port so as to atomize fuel entering the engine, with said fuel injector comprising:

a generally cylindrical nozzle for injecting fuel into the engine, with said nozzle having a fuel orifice;

an air shroud fitted on said nozzle and being adapted to communicate with the assist air port of the engine for directing air from the port toward said fuel orifice, so as to atomize said fuel emerging from said fuel orifice, and for targeting said fuel in the engine, with said air shroud comprising:

a generally cylindrical body disposed over said nozzle, with said body having a sidewall and a bottom wall;

a targeting section formed through said bottom wall, with said targeting section cooperating with said fuel orifice for targeting atomized fuel within the engine;

a throttling section formed on an inside surface of said sidewall upstream of said targeting section, with said throttling section and said nozzle defining a passage having a constricting cross section for throttling assist air prior to said assist air atomizing said fuel emerging from said fuel orifice.

12. A fuel injector according to claim 11 wherein said sidewall, said bottom wall and said fuel nozzle cooperate to define a mixing chamber for mixing assist air and fuel so as to aid in atomizing the fuel.

13. A fuel injector according to claim 12 further comprising a stop formed on said inside surface of said sidewall for axially locating said shroud relative to said fuel nozzle to define said mixing chamber.

14. A fuel injector according to claim 11 further comprising a port formed in said sidewall, with said port being adapted to communicate with the assist air port of the engine when the injector is installed in the engine.

15. An air shroud for an air assisted fuel injector for an internal combustion engine, with said shroud being adapted to cooperate with a nozzle of the fuel injector and being adapted to communicate with an assist air port of the engine, with said shroud directing air from the port toward a fuel orifice of the nozzle, so as to atomize fuel emerging from the fuel orifice, and targeting the atomized fuel entering the engine, with said shroud comprising:

a generally hollow cylindrical body having sidewall and a bottom wall, with said body being adapted to fit over the nozzle;

a targeting section formed through said bottom wall, with said targeting section being adapted to cooperate with the fuel orifice for targeting atomized fuel entering the engine;

a throttling section formed on an inside surface of said sidewall upstream of said targeting section, with said throttling section and said nozzle defining a passage therebetween having a converging cross section to constrict air flowing therethrough for throttling assist air prior to the assist air atomizing fuel emerging from the fuel orifice.

16. A shroud according to claim 15 wherein said sidewall and said bottom wall are adapted to cooperate with the fuel nozzle to define a mixing chamber for mixing assist air and fuel so as to aid in atomizing the fuel.

17. A shroud according to claim 15 further comprising a stop formed on said inside surface of said sidewall for axially locating said shroud relative to the nozzle, when installed thereon, to define said mixing chamber.

18. A fuel injector according to claim 15 further comprising a port formed in said sidewall, with said port being adapted to communicate with the assist air port of the engine when said shroud is installed on the fuel injector and when the injector is installed in the engine.

19. An air assisted fuel injector for an internal combustion engine, the engine having a fuel injector air assist port, with said air assist fuel injector cooperating with the air assist port so as to atomize fuel entering the engine, with said fuel injector comprising:

a generally cylindrical nozzle for injecting fuel into the engine, with said nozzle having a fuel orifice;

an air shroud fitted on said nozzle and being adapted to communicate with the assist air port of the engine for directing air from the port toward said fuel orifice, so as to atomize said fuel emerging from said fuel orifice, and for targeting said fuel in the engine, with said air shroud comprising:

a generally cylindrical body disposed over said nozzle, with said body having a bottom wall and a sidewall with an inside surface defined by a major diameter and a minor diameter;

a targeting section formed through said bottom wall, with said targeting section cooperating with said fuel orifice for targeting atomized fuel within the engine;

a throttling section formed on an inside surface of said sidewall upstream of said targeting section, with said throttling section being defined by a space between said major and said minor diameters, with said space generally converging along an axial direction extending toward said targeting section, said throttling section cooperating with said nozzle for throttling assist air prior to said assist air atomizing said fuel emerging from said fuel orifice.

20. An air shroud for an air assisted fuel injector for an internal combustion engine, with said shroud being adapted to cooperate with a nozzle of the fuel injector and being adapted to communicate with an assist air port of the engine, with said shroud directing air from the port toward a fuel orifice of the nozzle, so as to atomize fuel emerging from the fuel orifice, and targeting the atomized fuel entering the engine, with said shroud comprising:

a generally hollow cylindrical body having a bottom wall and a sidewall, said sidewall having an inside surface having a recess formed thereon and extending along an axial direction of said shroud, with said body being adapted to fit over the nozzle;

a targeting section formed through said bottom wall, with said targeting section being adapted to cooperate with the fuel orifice for targeting atomized fuel entering the engine;

a throttling section formed on an inside surface of said sidewall upstream of said targeting section, said throttling section comprising said recess having a generally converging cross-section as said recess approaches said targeting section, said throttling section being adapted to cooperate with the nozzle for throttling assist air prior to the assist air atomizing fuel emerging from the fuel orifice.

* * * * *